United States Patent [19]

Lucas

[11] Patent Number: 5,025,942

[45] Date of Patent: Jun. 25, 1991

[54] DEVICE FOR HANGING VARIOUS ACCESSORIES ON A SCREW RING OR ENDPIECE OF A CONTAINER

[75] Inventor: Marthe Lucas, La Grande Motte, France

[73] Assignee: Societe de Conseils et d'Tudes des Emballages S.C.E.E., Danmartin en Goele, France

[21] Appl. No.: 387,926

[22] Filed: Aug. 1, 1989

[30] Foreign Application Priority Data

Aug. 3, 1988 [FR] France ..... 88 10480

[51] Int. Cl.[5] ..... B65D 41/00

[52] U.S. Cl. ..... 215/318; 215/317; 220/289

[58] Field of Search ..... 222/83, 89, 91, 153, 222/546, 549, 551; 215/317, 318, 319, 321; 220/289

[56] References Cited

U.S. PATENT DOCUMENTS

| | | | |
|---|---|---|---|
| 2,829,807 | 4/1958 | Kirschenbaum | 222/546 X |
| 3,069,040 | 12/1962 | Corsette | 215/318 |
| 3,124,281 | 3/1964 | Stull | 222/546 X |
| 3,240,405 | 3/1966 | Abbott | 222/546 X |
| 3,318,496 | 5/1967 | Ayotte et al. | 222/546 |
| 3,690,503 | 9/1972 | Curry | 220/289 |
| 3,869,057 | 3/1975 | Miller | 215/216 |
| 4,377,248 | 3/1983 | Stull | 222/543 |
| 4,717,034 | 1/1988 | Mumford | 215/318 |
| 4,779,764 | 10/1988 | Debetencourt | 222/83 |

*Primary Examiner*—Stephen Marcus
*Assistant Examiner*—Nora Stucker
*Attorney, Agent, or Firm*—Browdy and Neimark

[57] ABSTRACT

The hooking device comprises an inside sleeve delimiting superimposed snap rings beaten-in by force between helicoidal threads of the screw ring of the container.

14 Claims, 3 Drawing Sheets

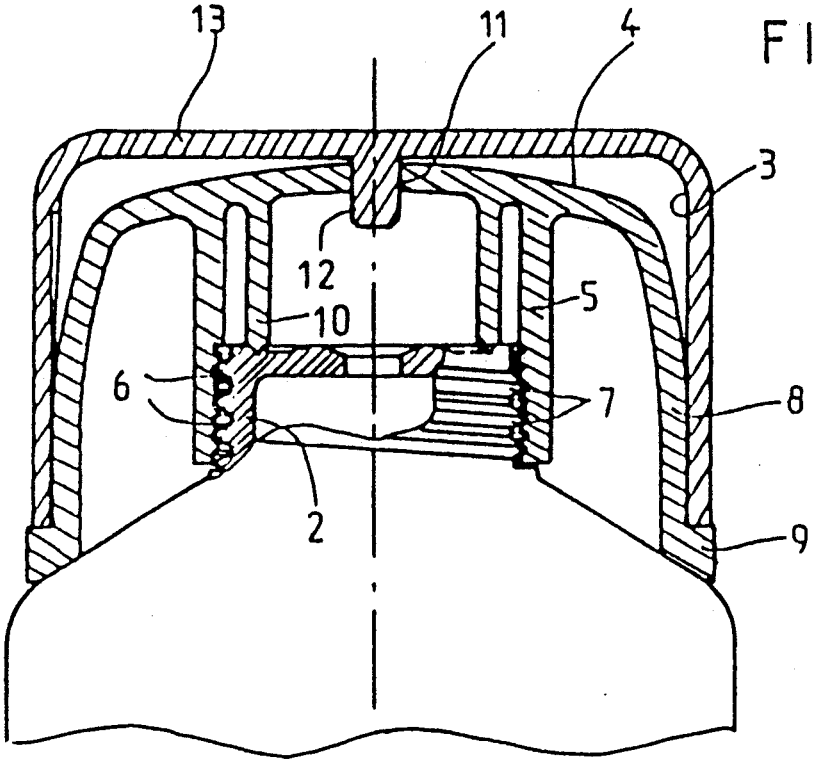
FIG. 1
FIG. 2
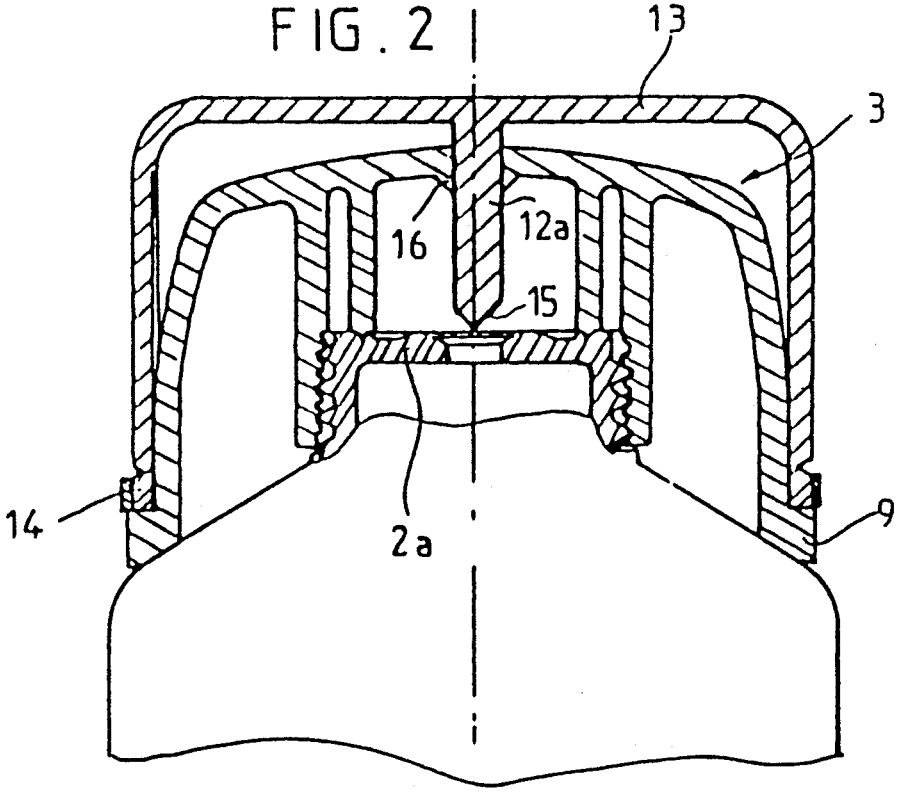

DEVICE FOR HANGING VARIOUS ACCESSORIES ON A SCREW RING OR ENDPIECE OF A CONTAINER

BACKGROUND OF THE INVENTION

Containers with a threaded neck or end-piece and more particularly tubes ending in a threaded neck or end-piece, are very often used to contain fluid products, for example, food or cosmetics.

It is also known to make containers, particularly tubes, designed to receive distributors, applicators and like accessories; and, for positioning such an accessory, a particular neck has generally to be designed at the extremity of the container. This is the case in the embodiment according to French patent 2,577,527 to Lucas, which is provided with a neck having projecting parts to stop rotation of the applicator.

In some countries, or when the above type of accessories has not to be produced on a large scale, the manufacturers of containers, particularly the manufacturers of tubes, do not create special necks and prefer to commercialize only tubes with threaded necks closed by a threaded plug.

An object of the invention is to make possible a positioning and attaching of accessories on containers, particularly on tubes originally provided with a threaded neck, without having to modify the manufacture of the containers and while making impossible a rotation or removal of the accessories when they are positioned.

The invention concerns all kinds of accessories, and particularly distributors, applicators, end pieces, caps of various types and, in case of need, the invention provides for an inviolability of the container, and typically of a tube, until being used.

SUMMARY OF THE INVENTION

According to the invention, the hooking device for attaching an accessory to a container having a threaded neck with helicoidal threads comprises an inside sleeve delimiting superimposed snap rings force driven-in between the helicoidal threads of the threaded neck.

Various other features of the invention are moreover revealed from the following detailed description.

BRIEF DESCRIPTION OF THE DRAWINGS

Embodiments of the invention are shown, as non limitative examples, in the enclosed drawings, wherein:

FIG. 1 is an elevation cross-section of an accessory in the form of an applicator or distributor to be attached to the threaded neck of a container, according to the invention.

FIG. 2 is an elevation cross-section similar to FIG. 1 showing a development of the invention.

DESCRIPTION OF PREFERRED EMBODIMENTS

Figure 3:
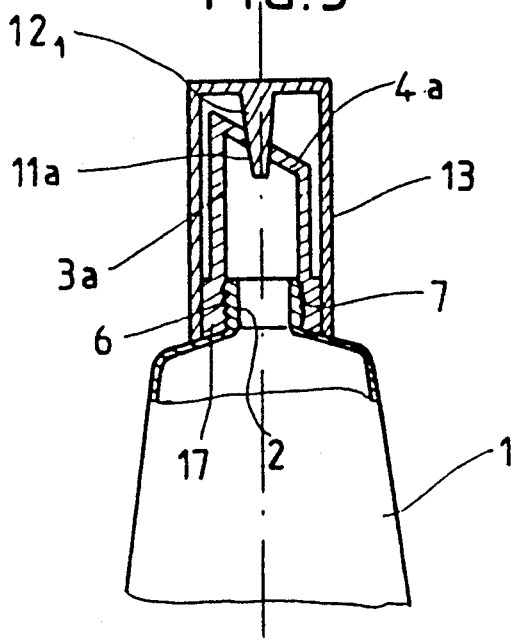
FIG. 3 is an elevation cross-section showing a variant.

In the drawings, reference numeral 1 shows a container preferably realized in the form of a tube, a flexible tube of plastics material, for example.

On its upper part, the container 1 has a threaded neck 2 through which a product contained in the container 1 can be delivered.

In the embodiment of FIGS. 1 and 2, the threaded neck 2 is used to fix an accessory formed by an applicator or distributor 3 with a top 4 having preferably a smooth external surface ; nevertheless the top 4 may have other configurations according to the product to be delivered.

For its fixation on the container 1, the applicator or distributor 3 comprises a sleeve 5, of which at least the internal lower part has a succession of parallel snap rings 6. As shown in the drawings, the snap rings 6, giving a ringed aspect to the base of the sleeve 5, have advantageously a trapezoidal cross-sectional shape.

It is advantageous that the number of snap rings 6 is greater than the number of helicoidal threads 7 on the threaded neck 2. In the illustrated example, the pitch of the threads 7 is a double of the pitch of the snap rings 6.

The lateral walls 8 of the applicator or distributor 3 extend to a flange 9 resting on the top of the container 1.

As shown in the drawings, it is advantageous to provide a skirt 10 extending inside the sleeve 5 and resting on top of the neck 2, in order to provide a tightness element preventing the product in the container 1 to come into contact with the snap rings 6 and threads 7.

As this is known, at least one hole 11 is typically drilled into the applicator or distributor 3, and the hole 11 is possibly closed by a finger 12 formed by a cover 13 covering the applicator or distributor 3.

In the illustrated example, both the applicator or distributor 3 and the cover 13 are made of a relatively flexible material, so that the cover 13 may be maintained on the applicator or distributor 3 by simple friction. Known fixing means may also be provided, and, for example, male and female notches respectively provided in the cover 13 and in the side wall of the applicator or distributor 3.

To position the applicator or distributor 3 on the container 1, it suffices to force drive-in it on the threads 7, with the snap rings 6 of the sleeve 5 coming imbricated and imprinted in these threads.

It is advantageous to provide that the constituting material of the applicator or distributor 3 is more rigid than that of the neck 2 and consequently than that of the threads 7, so that the threads 7 tend to be inserted between the snap rings 6, thus positively preventing a rotation of the applicator or distributor 3 with respect to the container 1.

FIG. 2 illustrates a development of the invention according to which the cover 13 is, at its base, fitted with a so-called inviolability ring 14, or even simply with a ring possibly withdrawn by rupture. In this case, the closing finger here referred to as 12*a* is prolongated by a point or blade 15 enabling to drill a part of the top 2*a* of the neck 2 by exerting a pressure on the cover 13, thus enabling the container 1 to remain tightly closed until use.

It is also advantageous to fit the bottom of the applicator or distributor 3 with lips or any other means 16 for drying or wiping the finger 12*a*, at each time the cover 13 is withdrawn.

FIG. 3 illustrates a variant according to which the applicator or distributor, here referred to as 3*a*, forms a bevelled top 4*a* provided with a hole 11*a* closed by a finger $12_1$ innerly protruding from the cover 13.

In the realization of FIG. 3, the junction between the neck 2 of the container 1 and the applicator or distributor 3*a* is realized as previously described by means of threads 7 of the neck 2 and snap rings 6 of the applicator or distributor 3*a*. Tightness between the applicator or distributor 3*a* and the container 1 is made by the base 17 of the applicator or distributor 3*a* which rests directly on the neck 2 of the container 1.

Figure 4:
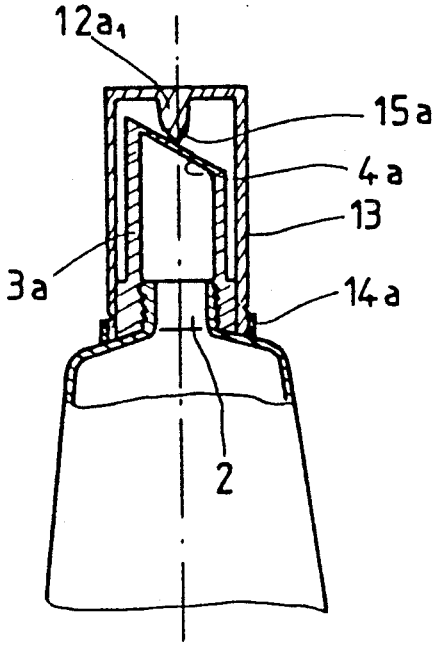
FIG. 4 is an elevation cross-section similar to FIG. 3 and showing another development of the invention comparable to that of FIG. 2 but applied to the variant of FIG. 3.

FIG. 4 illustrates a development according to which a ring 14*a*, similar to the ring 14 of FIG. 2 and able to be broken, is provided at a base of the cover 13 fitted with an innerly protruding finger $12a_1$ having a point 15*a* or a blade enabling to bore-in through the bevelled top 4*a* of the applicator or distributor 3*a*.

Figure 5:
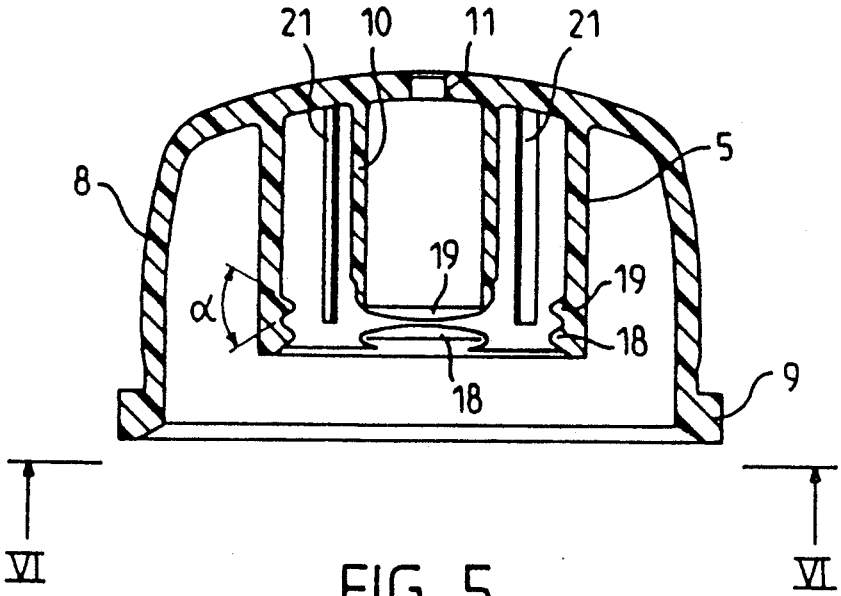
FIG. 5 is an elevation cross-section of a preferred realization of hooking members for attaching the accessory on the threaded neck of a container, not shown.
Figure 6:
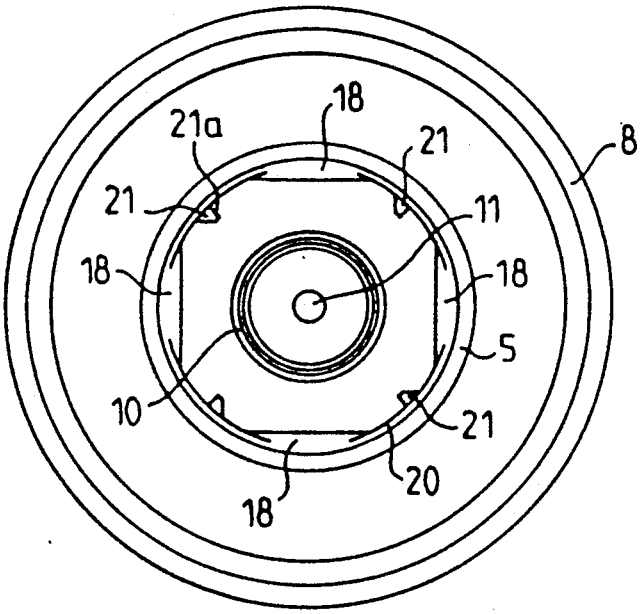
FIG. 6 is a view taken from line VI—VI of FIG. 5.

FIGS. 5 and 6 illustrate a preferred and particularly advantageous form of realization of the hooking member for attaching the accessory, this accessory being constituted by an applicator or distributor, as shown or forming a capsule or other device.

In FIG. 5, the elements which are similar to those in FIGS. 1–4 have the same reference numerals than in FIGS. 1–4, but the sleeve 5 is fitted with snap ring segments 18, 19 arranged on two levels.

It is advantageous for the snap ring segments 18, 19 to have a triangular cross-sectional shape, and to form an angle of about 60° as shown in FIG. 5.

FIG. 6 shows that each of the snap ring segments 18 and 19 may be four in number.

The length of the snap ring segments 18 and 19 is provided to leave an arcuate part 20, in the form of an arc of circle, between two segments 18 and between two other segments 19 which will thus constitute successive circular sectors separated the ones from the others.

An axial rib 21 is formed to protrude from each arcuate part 20 between each set of snap ring segments.

Each axial rib 21 may have a triangular shape as shown, with a side 21*a* directed according to a radius of the sleeve 5, which gives a high rigidity to the axial ribs 21.

FIG. 5 shows that the snap ring segments 18, 19 are advantageously formed to have a lenticular aspect, which means that both their top and bottom are curved.

In practice, the arcuate parts 20 have a diameter corresponding more or less to the external diameter of the threads 7 of the previously described threaded necks 2, 2*a*.

From the hereabove described features, it results that when driving the sleeve 5 in a threaded end-piece of a container, for example the threaded neck 2 or 2*a* of FIGS. 1–4, the arcuate parts 20 form a guide centering the sleeve 5 in relation to the threaded neck. Furthermore, and since the snap ring segments 18, 19 have a lenticular shape, it results therefrom that, when they are force driven-in, these snap ring segments cause at least a resilient deformation of the threads 7 of the threaded ring neck 2 or 2*a* and are finally introduced in the roots of the threads, thus providing an axial locking of the sleeve 5 in relation to the threaded neck 2 or 2*a*.

During the driving-in movement of the sleeve 5, and due to their triangular shapes, each of the ribs 21 acts like punches and tends to form an axial cut or groove in the threads 7 of the threaded neck 2 or 2*a*; thus, at the end of the stroke the sleeve 5 cannot rotate due to the ribs 21 engaged in the cuts or grooves they have formed, and the sleeve 5 cannot slide axially to be extracted, the snap ring segments 18 and 19 being placed in the root of some of the threads 7 of the threaded neck 2 or 2*a*.

The above disclosure shows that the attaching members are only formed by the sleeve 5, which makes that such a sleeve can be connected to, or to be part of, any accessory of the type as mentioned above.

What is claimed is:

1. Hooking device for attaching an accessory to a container having a threaded neck with deformable helicoidal threads, said hooking device comprising an inside sleeve, rigid superimposed snap rings on an inner periphery of said inside sleeve, said rigid superimposed snap rings being adapted to be force driven in between the helicoidal threads of the container whereby the helicoidal threads are resiliently deformed between said snap rings and said accessory is thereby positively prevented from rotating with respect to said container.

2. The hooking device as set forth in claim 1, wherein said snap rings are made of rigid superimposed snap ring segments, and the hooking device further comprises an arcuate part between said superimposed snap ring segments, said arcuate part having a diameter corresponding substantially to an external diameter of the deformable helicoidal threads.

3. The device as set forth in claim 2, wherein said snap ring segments have a lenticular shape.

4. The device as set forth in claim 2, wherein said snap ring segments have a cross-section having the shape of a tapered triangle with a taper of substantially 60°.

5. The device as set forth in claim 2, further comprising axial ribs protruding from said arcuate part.

6. The device as set forth in claim 1, comprising two sets of four superimposed snap ring segments, axial ribs protruding between said snap ring segments.

7. The device as set forth in claim 5, wherein said axial ribs have an approximately triangular cross-section.

8. The device as set forth in claim 7, wherein said axial ribs have one side which extends radially.

9. The device as set forth in claim 1, further comprising sealing means arranged inside said sleeve.

10. The device as set forth in claim 1, wherein said snap rings and the helicoidal threads each have a pitch, with the pitch of said snap rings being smaller than the pitch of the helicoidal threads.

11. The device as set forth in claim 1, wherein said accessory is made of a material harder than that constituting the helicoidal threads.

12. The device as set forth in claim 9, wherein said sealing means are constituted by a skirt resting on a top of the threaded neck, with said skirt extending inside said sleeve.

13. The device as set forth in claim 9, comprising a base, and wherein said sealing means are constituted by said base.

14. The device as set forth in claim 1, further comprising a breakable inviolability ring.

* * * * *